US012435537B1

(12) United States Patent
Hiebert

(10) Patent No.: US 12,435,537 B1
(45) Date of Patent: Oct. 7, 2025

(54) POST PULLER

(71) Applicant: Enrique Hiebert, Hays (CA)

(72) Inventor: Enrique Hiebert, Hays (CA)

( * ) Notice: Subject to any disclaimer, the term of this patent is extended or adjusted under 35 U.S.C. 154(b) by 347 days.

(21) Appl. No.: 18/208,339

(22) Filed: Jun. 12, 2023

(51) Int. Cl.
*E04H 17/26* (2006.01)

(52) U.S. Cl.
CPC ..... *E04H 17/265* (2013.01)

(58) Field of Classification Search
CPC ..... E04H 17/265; E04H 17/263
See application file for complete search history.

(56) References Cited

U.S. PATENT DOCUMENTS

| | | | | |
|---|---|---|---|---|
| 1,700,008 | A | 1/1929 | Wester | |
| 2,160,891 | A | 6/1939 | Neff | |
| 2,740,210 | A | 4/1956 | Hamborg | |
| 3,549,126 | A | 12/1970 | Devries | |
| 6,527,250 | B1 * | 3/2003 | Tyson | E04H 17/265 254/30 |
| 7,059,587 | B1 * | 6/2006 | Fimple | E04H 17/265 254/133 R |
| 7,125,000 | B1 * | 10/2006 | Saavedra | E04H 17/265 254/30 |
| 10,858,229 | B1 | 12/2020 | Tucker | |
| 12,038,026 | B2 * | 7/2024 | Blank | B25C 11/00 |
| 2007/0090332 | A1 | 4/2007 | Mensi et al. | |
| 2009/0315003 | A1 | 12/2009 | Slagle | |
| 2010/0260590 | A1 | 10/2010 | Ford | |
| 2017/0196174 | A1 | 7/2017 | Niekamp | |

* cited by examiner

*Primary Examiner* — Lee D Wilson
(74) *Attorney, Agent, or Firm* — Cramer Patent & Design, PLLC.; Aaron R. Cramer

(57) ABSTRACT

The post puller may comprise an equipment coupler, a post coupler, a linkage, and an elastic cord. The post puller may be configured to detachably couple to a lifting subsystem of a piece of equipment via the equipment coupler and to a post via the post coupler. The post puller may be operable to pull the post out of the ground as the piece of equipment moves the post puller rearward and upward. The elastic cord may cause the post puller to release the post once the post is out of the ground. As non-limiting examples, the piece of equipment may be a tractor, or a front loader and the lifting subsystem may be a pallet fork or a bucket.

20 Claims, 5 Drawing Sheets

POST PULLER

RELATED APPLICATIONS

None.

FIELD OF THE INVENTION

The present invention relates generally to a pulling device and more specifically to a pulling device for a post.

BACKGROUND OF THE INVENTION

Domesticated animals on farms and ranches across the country have been contained by fences for years. Whether the fence is made of wire, barbed wire, net material or the like, a fence post forms the foundation of many different styles. Different styles of fence posts are often used for temporary or semi-permanent fencing which means that the posts must be frequently removed as well. Many people rely on brute force methods which take a lot of effort and/or result in damaged posts which must then be discarded and subsequently replaced.

Others may rely on heavy machinery such as skid steer machines or back hoes, but the means to connect the machine to the post for pulling is lacking. This leads to makeshift apparatuses that can create dangerous situations for all involved, should they snap, slip, or give way. Accordingly, there exists a need for a means by which fence posts can be easily removed without the disadvantages as described above. The development of the Post Puller is such a solution.

SUMMARY OF THE INVENTION

Embodiments of the present disclosure may include a post puller, including an equipment coupler having a pallet fork interface, a bucket interface and an upper linkage interface. Embodiments may also include a post coupler having a post coupler left wall, a post coupler right wall, a post coupler front wall, and a post coupler rear wall, the post coupler includes a lower linkage interface disposed on a front side of the post coupler that may be adapted to grasp a post.

Embodiments may also include a linkage having a top, a bottom, a left linkage armature with a top and a bottom, a right linkage armature with a top and a bottom, an upper linkage brace, and a lower linkage brace, the upper linkage interface may be disposed beneath the pallet fork interface that pivotably couples the equipment coupler on the top of the linkage and the lower linkage interface pivotably couples the post coupler to the bottom of the linkage. Embodiments may also include an elastic cord having a top and a bottom, the elastic cord retains the post coupler in a substantially horizontal orientation until the post coupler may be adapted to be tilted during removal of the post.

In some embodiments, the pallet fork interface may be adapted to couple to an individual fork of a pallet fork. In some embodiments, the pallet fork interface may be adapted to be placed onto the individual fork by aligning the pallet fork aperture with the individual fork and sliding the pallet fork interface onto the individual fork. In some embodiments, the post puller, according to may include one or more pallet clamps may be tightened against the individual fork to retain the equipment coupler on the individual fork.

In some embodiments, the pallet fork interface may be a hollow rectangular tube with a pallet fork aperture that passes entirely through the pallet fork interface. In some embodiments, the pallet fork aperture may be oriented to be open from front to rear. In some embodiments, the pallet fork interface or the bucket interface may be used to pull the post.

In some embodiments, the bucket interface couples to a front edge of a bucket. In some embodiments, the post coupler may be a hollow rectangular box that may be open from top to bottom. In some embodiments, the post coupler front wall includes a front gripper located on an inside top of the post coupler front wall and the post coupler rear wall includes a rear gripper located on an inside bottom of the post coupler rear wall.

In some embodiments, the left linkage armature and the right linkage armature may be vertically-oriented armatures. In some embodiments, the left linkage armature and the right linkage armature may be parallel to each other and may be of equal lengths. In some embodiments, the tops of the left linkage armature and the right linkage armature may be pivotably coupled to the upper linkage interface on the equipment coupler.

In some embodiments, the bottoms of the left linkage armature and the right linkage armature may be pivotably coupled to the lower linkage interface on the post coupler. Embodiments may also include an inside distance between the left linkage armature and the right linkage armature may be at least as large as the width of the post such that the post passes between the left linkage armature and the right linkage armature.

In some embodiments, the upper linkage brace and the lower linkage brace may be laterally oriented armatures that hold the left linkage armature and the right linkage armature separated at a fixed distance. In some embodiments, the upper linkage brace may be located at the top of the linkage and the lower linkage brace may be located at the bottom of the linkage such that the upper linkage brace and the lower linkage brace may be free of interfering with the post passing between the left linkage armature and the right linkage armature.

In some embodiments, the linkage includes one or more upper bungee attachment points that may be located at the center of the left side of the linkage. In some embodiments, the top of the elastic cord may be coupled to one of the one or more upper bungee attachment points and the bottom of the elastic cord may be coupled to the lower bungee attachment point on the post coupler. In some embodiments, the post may be lifted and the post falls from the post coupler and tension on the elastic cord pulls the post coupler back into the substantially horizontal orientation.

BRIEF DESCRIPTION OF THE FIGURES

The advantages and features of the present invention will become better understood with reference to the following more detailed description and claims taken in conjunction with the accompanying drawings, in which like elements are identified with like symbols, and in which:

DESCRIPTIVE KEY

Figure 1:
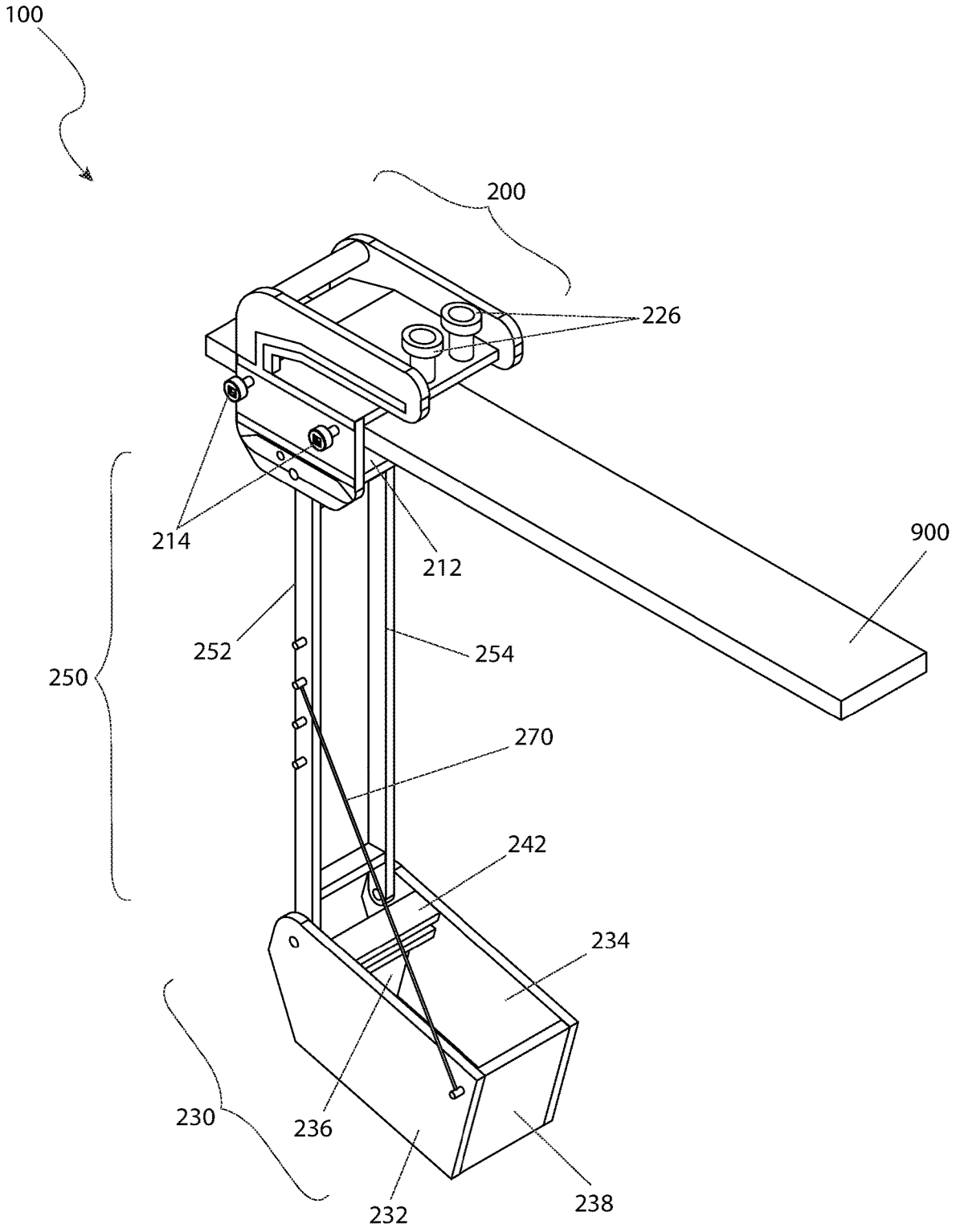
FIG. 1 is an isometric view of a post puller, according to an embodiment of the present invention.
Figure 2:
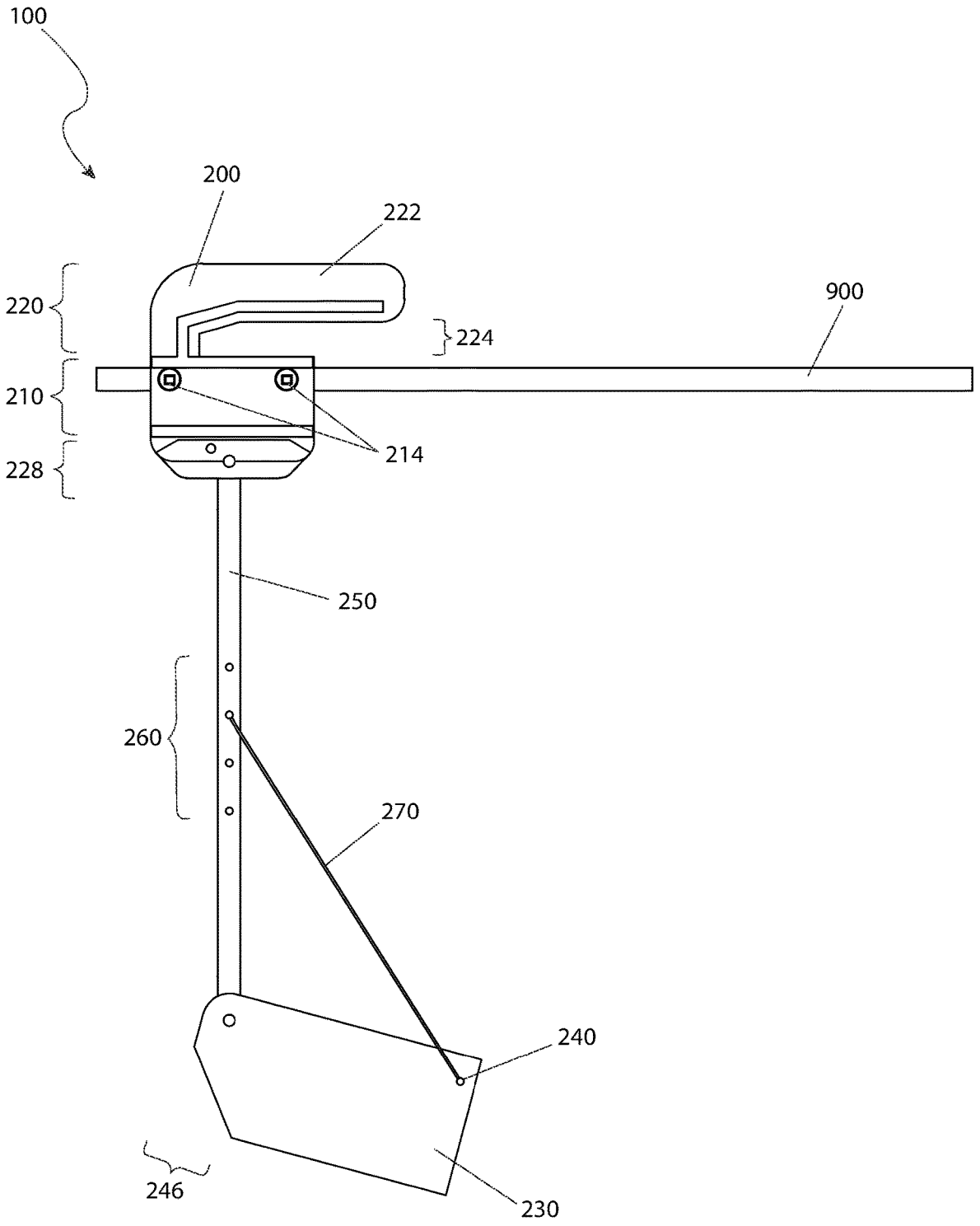
FIG. 2 is a side view of a post puller, according to an embodiment of the present invention.
Figure 3:
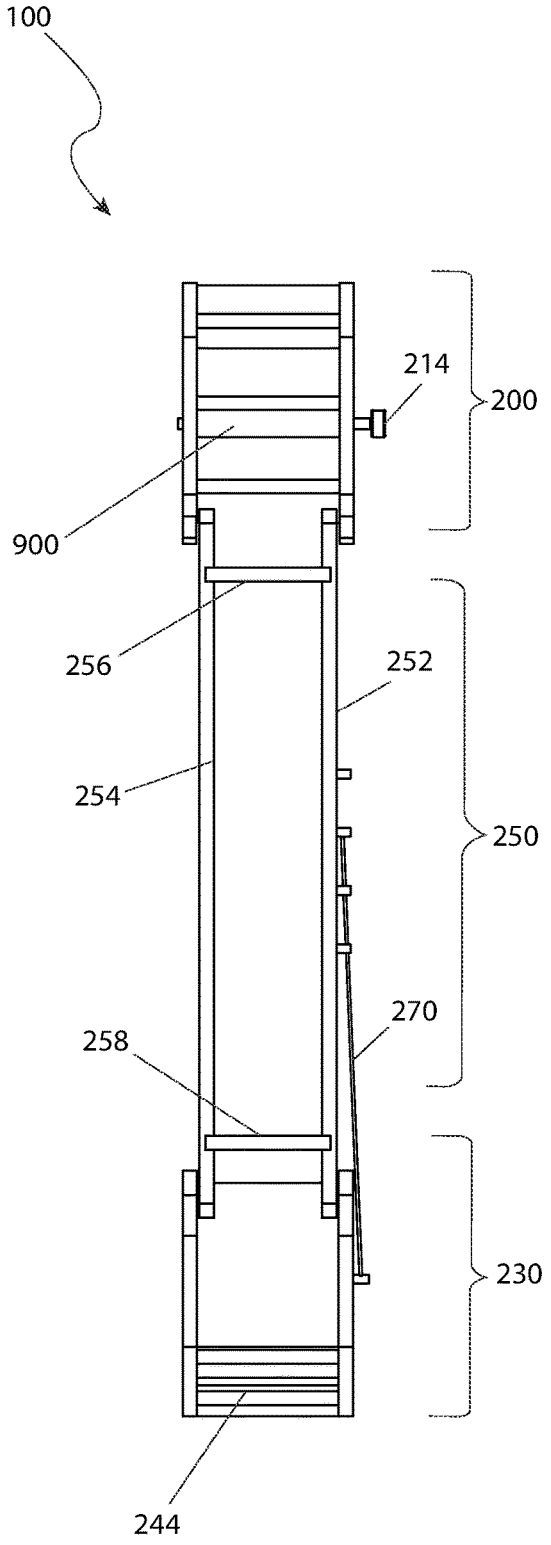
FIG. 3 is a front view of a post puller, according to an embodiment of the present invention.
Figure 4:
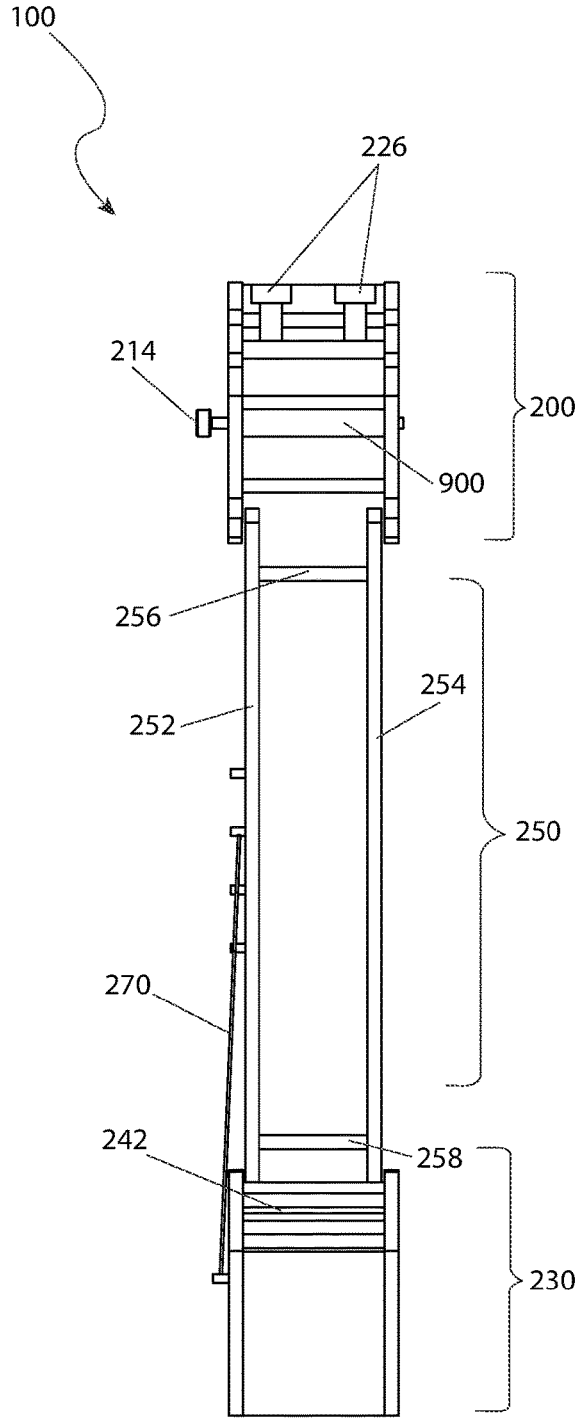
FIG. 4 is a rear view of a post puller, according to an embodiment of the present invention.
Figure 5:
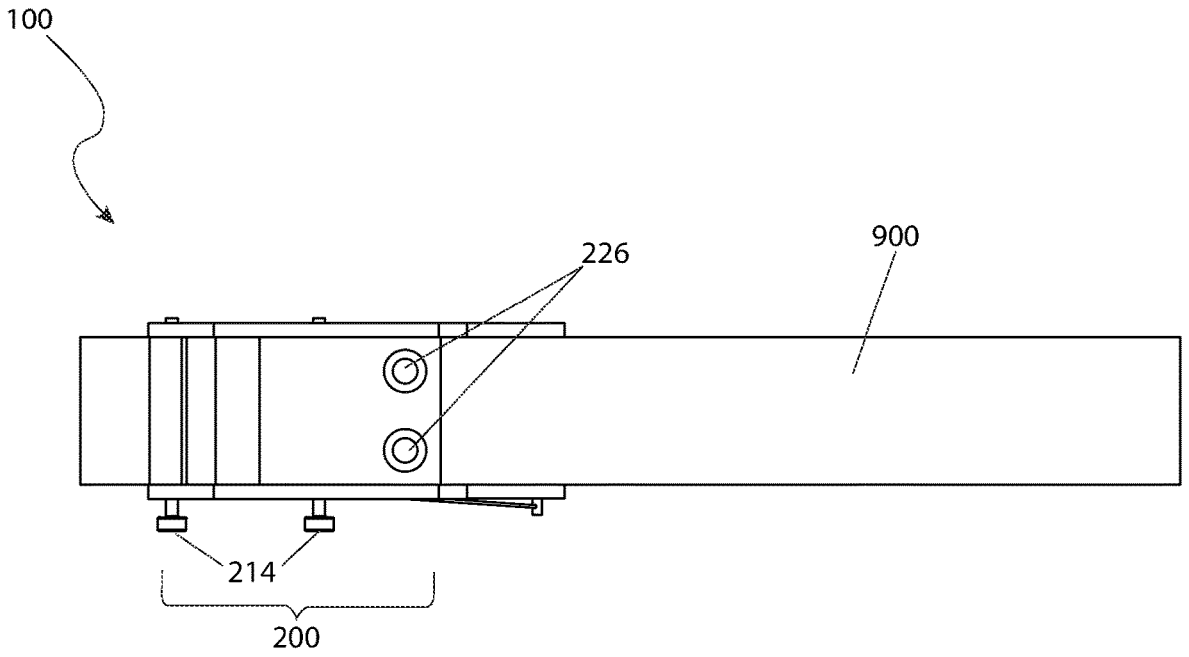
FIG. 5 is a top view of a post puller, according to an embodiment of the present invention.
Figure 6:
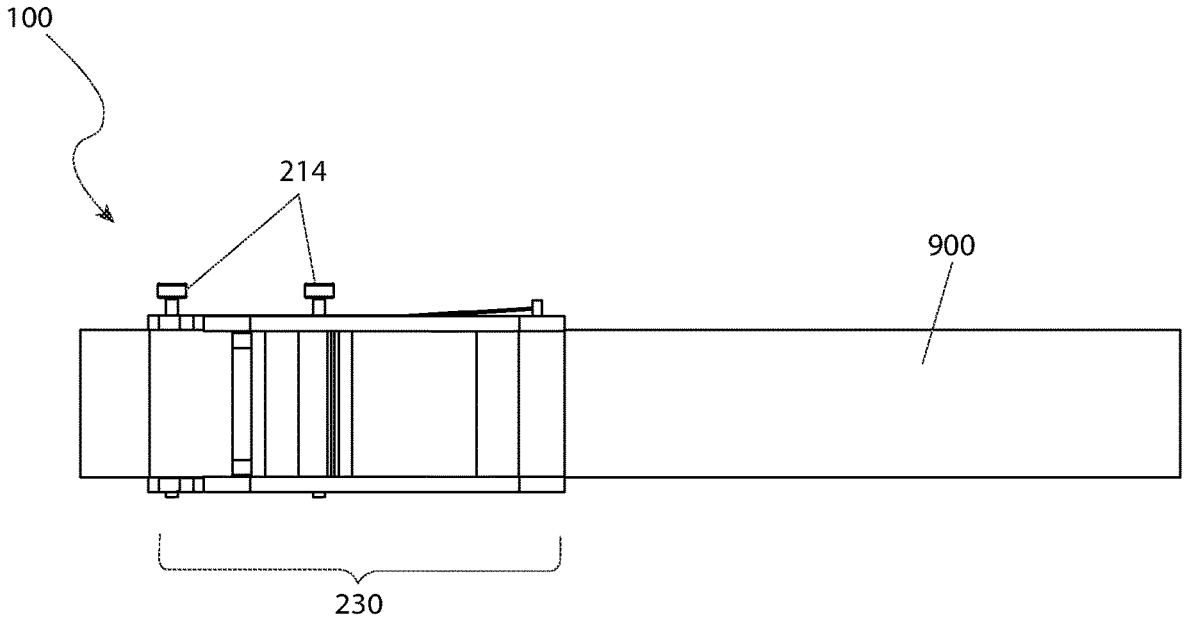
FIG. 6 is a bottom view of a post puller, according to an embodiment of the present invention.
Figure 7:
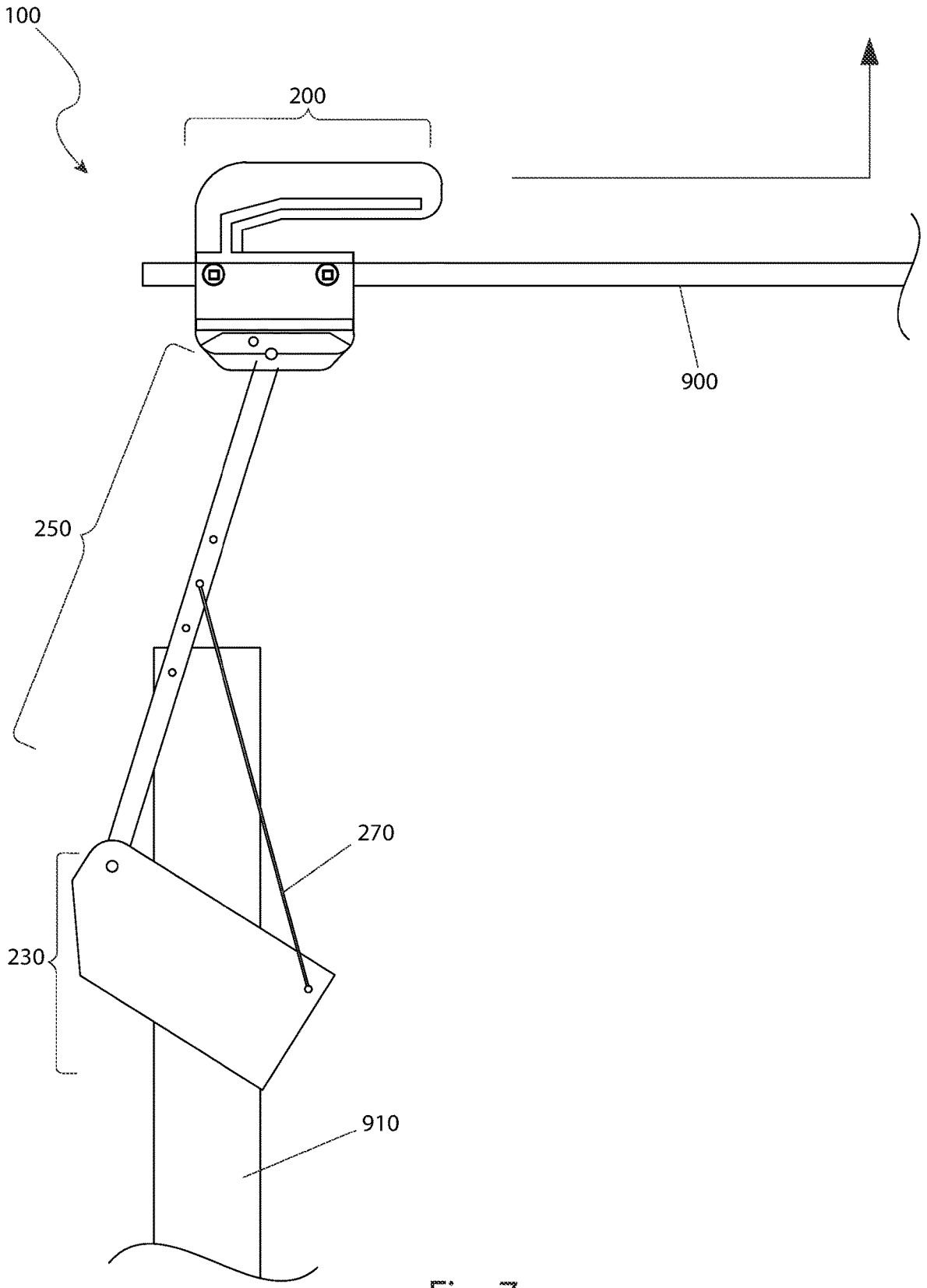
FIG. 7 is an in-use view of a post puller, according to an embodiment of the present invention.

100 post puller
200 equipment coupler
210 pallet fork interface
212 pallet fork aperture
214 pallet clamp
220 bucket interface
222 bucket hook
224 bucket slot
226 bucket clamp
228 upper linkage interface
230 post coupler
232 post coupler left wall
234 post coupler right wall
236 post coupler front wall
238 post coupler rear wall
240 lower bungee attachment point
242 front gripper
244 rear gripper
246 lower linkage interface
250 linkage
252 left linkage armature
254 right linkage armature
256 upper linkage brace
258 lower linkage brace
260 upper bungee attachment point
270 elastic cord
900 individual fork
910 post

DESCRIPTION OF THE INVENTION

The present invention is directed to a post puller (herein described as the "invention") 100. The invention 100 may comprise an equipment coupler 200, a post coupler 230, a linkage 250, and an elastic cord 270. The invention 100 may be configured to detachably couple to a lifting subsystem of a piece of equipment via the equipment coupler 200 and to a post 910 via the post coupler 230. The invention 100 may be operable to pull the post 910 out of the ground as the piece of equipment moves the invention 100 rearward and upward. The elastic cord 270 may cause the invention 100 to release the post 910 once the post 910 is out of the ground. As non-limiting examples, the piece of equipment may be a tractor or a front loader and the lifting subsystem may be a pallet fork or a bucket.

The equipment coupler 200 may be configured to detachably couple to the lifting subsystem of the piece of equipment. The equipment coupler 200 may comprise a pallet fork interface 210 for coupling to an individual fork 900 of the pallet fork and a bucket interface 220 for coupling to a front edge of the bucket. Either the pallet fork interface 210 or the bucket interface 220 may be used to pull the post 910.

The pallet fork interface 210 may be a hollow rectangular tube comprising a pallet fork aperture 212 that passes entirely through the pallet fork interface 210. The pallet fork aperture 212 may be oriented to be open from front to rear. The pallet fork interface 210 may be configured to be placed onto the individual fork 900 by aligning the pallet fork aperture 212 with the individual fork 900 and sliding the pallet fork interface 210 onto the individual fork 900. One (1) or more pallet clamps 214 may be tightened against the individual fork 900 to retain the equipment coupler 200 on the individual fork 900.

The bucket interface 220 may comprise a bucket hook 222 coupled to the top of the pallet fork interface 210. The bucket hook 222 may open to the rear such that the front edge of the bucket may slide into a bucket slot 224 located between the bucket hook 222 and the pallet fork interface 210 from the rear. One (1) or more bucket clamps 226 may be tightened against the bucket to retain the equipment coupler 200 on the bucket.

The equipment coupler 200 may comprise an upper linkage interface 228 located beneath the pallet fork interface 210. The upper linkage interface 228 may pivotably couple the equipment coupler 200 to the top of the linkage 250.

The post coupler 230 may be configured to grasp the post 910. The post coupler 230 may be a hollow rectangular box. The post coupler 230 may be open from top to bottom. The post coupler 230 may be lowered over the post 910 and may encircle the post 910.

The post coupler 230 may comprise a post coupler left wall 232, a post coupler right wall 234, a post coupler front wall 236, and a post coupler rear wall 238. The post coupler left wall 232 and the post coupler right wall 234 may prevent the post 910 from exiting the post coupler 230 due to lateral movement of the post coupler 230. The post coupler front wall 236 and the post coupler rear wall 238 may prevent the post 910 from exiting the post coupler 230 due to forward or rearward movement of the post coupler 230.

The post coupler front wall 236 may comprise a front gripper 242 located on the inside top of the post coupler front wall 236. The post coupler rear wall 238 may comprise a rear gripper 244 located on the inside bottom of the post coupler rear wall 238. As the post coupler 230 is moved rearward, the front gripper 242 may press against the post 910 causing the post coupler 230 to pivot such that the rear of the post coupler 230 is lowered until the rear gripper 244 presses against the post 910. Lifting the post coupler 230 may then cause the front gripper 242 and the rear gripper 244 to seize the post 910 and pull the post 910 up out of the ground.

The post coupler left wall 232 may comprise a lower bungee attachment point 240. The lower end of the elastic cord 270 may couple to the post coupler 230 via the lower bungee attachment point 240.

The post coupler 230 may comprise a lower linkage interface 246 located on the front side of the post coupler 230. The lower linkage interface 246 may pivotably couple the post coupler 230 to the bottom of the linkage 250.

The linkage 250 may be an open framework that is operable to suspend the post coupler 230 beneath the equipment coupler 200. The linkage 250 may comprise a left linkage armature 252, a right linkage armature 254, an upper linkage brace 256, and a lower linkage brace 258. The left linkage armature 252 and the right linkage armature 254 may be vertically-oriented armatures. The left linkage armature 252 and the right linkage armature 254 may be parallel to each other and may be of equal lengths. The tops of the left linkage armature 252 and the right linkage armature 254 may be pivotably coupled to the upper linkage interface 228 on the equipment coupler 200. The bottoms of the left linkage armature 252 and the right linkage armature 254 may be pivotably coupled to the lower linkage interface 246 on the post coupler 230.

The inside distance between the left linkage armature 252 and the right linkage armature 254 may be at least as large as the width of the post 910 such that the post 910 may pass between the left linkage armature 252 and the right linkage armature 254. The upper linkage brace 256 and the lower linkage brace 258 may be laterally-oriented armatures that hold the left linkage armature 252 and the right linkage armature 254 separated at a fixed distance. The upper linkage brace 256 may be located at the top of the linkage 250 and the lower linkage brace 258 may be located at the bottom of the linkage 250 such that the upper linkage brace 256 and the lower linkage brace 258 are free of interfering with the post 910 passing between the left linkage armature 252 and the right linkage armature 254.

The linkage 250 may comprise one or more upper bungee attachment points 260 that may be located at the center of the left side of the linkage 250. The top of the elastic cord 270 may be coupled to one (1) of the upper bungee attachment points 260 and the bottom of the elastic cord 270 may be coupled to the lower bungee attachment point 240 on the post coupler 230.

The elastic cord 270 may retain the post coupler 230 in a substantially horizontal orientation until the post coupler 230 is tilted during post removal. Tilting the post coupler 230 may increase a tension on the elastic cord 270. As the post 910 is lifted, the post 910 may fall from the post coupler 230 to the ground. The tension on the elastic cord 270 may then pull the post coupler 230 back into the horizontal orientation.

In use, the equipment coupler 200 may be removably coupled to the lifting subsystem of the piece of equipment. As non-limiting examples, the equipment coupler 200 may couple to an individual fork 900 of a pallet fork or to the front edge of a bucket. The piece of equipment may position the post coupler 230 above the post 910 and may lower the post coupler 230 onto the post 910, typically on the order of two feet (2 ft.) down onto the post 910. The piece of equipment may pull the equipment coupler 200 rearward such that the post coupler 230 pivots and grasps the post 910. The piece of equipment may lift the post coupler 230 to pull the post 910 from the ground. Once clear of the ground, the post 910 may fall from the post coupler 230 and the elastic cord 270 may position the post coupler 230 for use on another post.

The exact specifications, materials used, and method of use of the invention 100 may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A post puller, comprising:

an equipment coupler having a pallet fork interface, a bucket interface and an upper linkage interface;

a post coupler having a post coupler left wall, a post coupler right wall, a post coupler front wall, and a post coupler rear wall, the post coupler includes a lower linkage interface disposed on a front side of the post coupler that is adapted to grasp a post;

a linkage having a top, a bottom, a left linkage armature with a top and a bottom, a right linkage armature with a top and a bottom, an upper linkage brace, and a lower linkage brace, the upper linkage interface is disposed beneath the pallet fork interface that pivotably couples the equipment coupler on the top of the linkage and the lower linkage interface pivotably couples the post coupler to the bottom of the linkage; and an elastic cord having a top and a bottom, the elastic cord retains the post coupler in a substantially horizontal orientation until the post coupler is adapted to be tilted during removal of the post.

2. The post puller, according to claim 1, wherein the pallet fork interface is adapted to couple to an individual fork of a pallet fork.

3. The post puller, according to claim 2, wherein the pallet fork interface is adapted to be placed onto the individual fork by aligning the pallet fork aperture with the individual fork and sliding the pallet fork interface onto the individual fork.

4. The post puller, according to claim 3, further comprising one or more pallet clamps are tightened against the individual fork to retain the equipment coupler on the individual fork.

5. The post puller, according to claim 3, wherein the pallet fork interface is a hollow rectangular tube with a pallet fork aperture that passes entirely through the pallet fork interface.

6. The post puller, according to claim 5, wherein the pallet fork aperture is oriented to be open from front to rear.

7. The post puller, according to claim 1, wherein the pallet fork interface or the bucket interface is used to pull the post.

8. The post puller, according to claim 1, wherein the bucket interface couples to a front edge of a bucket.

9. The post puller, according to claim 1, wherein the post coupler is a hollow rectangular box that is open from top to bottom.

10. The post puller, according to claim 1, wherein the post coupler front wall includes a front gripper located on an inside top of the post coupler front wall and the post coupler rear wall includes a rear gripper located on an inside bottom of the post coupler rear wall.

11. The post puller, according to claim 1, wherein the left linkage armature and the right linkage armature are vertically-oriented armatures.

12. The post puller, according to claim 1, wherein the left linkage armature and the right linkage armature are parallel to each other and are of equal lengths.

13. The post puller, according to claim 1, wherein the tops of the left linkage armature and the right linkage armature are pivotably coupled to the upper linkage interface on the equipment coupler.

14. The post puller, according to claim 1, wherein the bottoms of the left linkage armature and the right linkage armature are pivotably coupled to the lower linkage interface on the post coupler.

15. The post puller, according to claim 1, wherein an inside distance between the left linkage armature and the right linkage armature are at least as large as the width of the post such that the post passes between the left linkage armature and the right linkage armature.

16. The post puller, according to claim 1, wherein the upper linkage brace and the lower linkage brace are laterally-oriented armatures that hold the left linkage armature and the right linkage armature separated at a fixed distance.

17. The post puller, according to claim 1, wherein the upper linkage brace is located at the top of the linkage and the lower linkage brace is located at the bottom of the linkage such that the upper linkage brace and the lower linkage brace are free of interfering with the post passing between the left linkage armature and the right linkage armature.

18. The post puller, according to claim 1, wherein the linkage includes one or more upper bungee attachment points that are located at the center of the left side of the linkage.

19. The post puller, according to claim 18, wherein the top of the elastic cord is coupled to one of the one or more upper bungee attachment points and the bottom of the elastic cord is coupled to the lower bungee attachment point on the post coupler.

20. The post puller, according to claim 18, wherein the post is lifted and the post falls from the post coupler and tension on the elastic cord pulls the post coupler back into the substantially horizontal orientation.

* * * * *